United States Patent [19]

Mieth et al.

[11] Patent Number: 4,695,785

[45] Date of Patent: Sep. 22, 1987

[54] CIRCUIT ARRANGEMENT FOR FEEDING AN ELECTRICAL LOAD FROM A SOLAR GENERATOR

[75] Inventors: Guenther Mieth, Munich; Ulf Schwarz, Pullach, both of Fed. Rep. of Germany

[73] Assignee: Siemens Aktiengesellschaft, Berlin and Munich, Fed. Rep. of Germany

[21] Appl. No.: 876,452

[22] Filed: Jun. 20, 1986

[30] Foreign Application Priority Data

Jun. 20, 1985 [DE] Fed. Rep. of Germany ..... 3522080

[51] Int. Cl.[4] ..... G05F 1/565

[52] U.S. Cl. ..... 323/222; 323/906; 323/285

[58] Field of Search ..... 323/222, 299, 282, 283, 323/284, 285, 906; 363/21; 136/293

[56] References Cited

U.S. PATENT DOCUMENTS 3,626,198 12/1971 Boehringer ..... 323/222 X
4,272,806 6/1981 Metzger ..... 323/906 X
4,494,180 1/1985 Streater et al. ..... 323/906 X
4,604,567 8/1986 Chetty ..... 323/906 X

FOREIGN PATENT DOCUMENTS 2043423 1/1972 Fed. Rep. of Germany .
2175653 10/1973 France .

OTHER PUBLICATIONS

"MPP-Solar-Ladegerät", Elektronik, 19/21.9, 1984, p. 96.

*Primary Examiner*—Peter S. Wong
*Attorney, Agent, or Firm*—Hill, Van Santen, Steadman & Simpson

[57] ABSTRACT

A circuit arrangement for feeding an electrical load, solar generator provides that the current output by the solar generator has a prescribed ratio to the measured value which is a measure for the short-circuit current of the solar generator. Such a circuit arrangement has an optimally-high efficiency. This is achieved with comparatively low expense in that the short-circuit current of the solar generator is measured pulse-wise. The circuit arrangement can be employed with particular advantage for charging batteries in solar systems.

5 Claims, 4 Drawing Figures

CIRCUIT ARRANGEMENT FOR FEEDING AN ELECTRICAL LOAD FROM A SOLAR GENERATOR

BACKGROUND OF THE INVENTION

1. Field of the Invention

The present invention relates to a circuit arrangement for feeding an electrical load from a solar generator comprising an input for connection to the solar generator and an output for connection to the electrical load, whereby a final control element is controlled by a control circuit and is arranged between the input and the output, the control circuit having a reference voltage input connected to a reference voltage generator which is controlled by a light sensor, and in which the reference voltage generator is an arrangement for measuring a signal for short-circuit current of the solar generator and the final control element is controlled by the control circuit such that the current drawn from the solar generator has a prescribed ratio to the respective measured value of the signal for the short-circuit current of the solar generator.

2. Description of the Prior Art

A circuit arrangement of the type set forth above has been disclosed in the German published application No. 20 43 423, fully incorporated herein by this reference. The known circuit arrangement is a two-stage action controller which is fed from a solar generator. The two-stage action controller is designed and dimensioned such that the current output by the solar generator has a prescribed ratio to the short-circuit current of a reference solar generator. This ratio is identified with the assistance of the characteristic field of the solar generator as the factor by which the short-circuit is to be multiplied in order to obtain the current in the operating point of maximum power. A test cell belonging to the solar generator serves as a reference solar generator. The solar generator feeding the load and the solar generator whose short-circuit current is measured are therefore of the same type. In this manner, the operating point of maximum power is obtained with good approximation in a great temperature range of the solar generator, and this is accomplished with relatively simple structure. The circuit arrangement serves, in particular, for charging a battery or for feeding loads which are buffered with the assistance of a battery. The proposed type of current matching, however, can also be advantageous in other loads when an optimally great load of the solar generator is desired. The circuit arrangement can be a component portion of a regulator or of an arrangement for what is referred to as forward-acting regulation wherein the final control element is controlled in a prescribed dependency on the measured short-circuit current.

Since the test cell is constantly loaded by a precision resistor, it is not available for a feed of the load. Moreover, the measured value of the short-circuit current of the test cell which serves as a signal for the short-circuit current of the solar cell is only an approximate value, since conclusions regarding the entire solar generator are drawn based on the properties of the test cell.

Given a circuit arrangement known from the periodical "Elektronik", 19/21, Sept. 1984, p. 96, a switching regulator is connected to a solar generator, the output voltage of the circuit arrangement being held at a described value with the assistance of the switching regulator. This is achieved in that the actual value input of the switching regulator is connected to a tap of a first voltage divider which is connected in parallel to the output of the circuit arrangement. The switching regulator comprises a further control input which is internally connected to a reference voltage source. This control input lies at a tap of a second voltage divider which is connected to the solar generator. A photodiode is connected directly adjacent the solar generator, the photodiode being arranged parallel to a resistor of the second voltage divider.

A maximum of power is to be gained from the solar generator with the assistance of the known circuit arrangement in that the reference voltage effective in combination with a voltage regulation is to be correspondingly influenced by the photodiode given a changing light irradiation. In addition to the radiation density, the temperature also has a significant influence on the generator voltage in the operating point of maximum power given a solar generator. In the known circuit arrangement, however, the latter is not taken into consideration.

A typical characteristic field of a solar generator may be found, for example, from the brochure "Solar Modules, Type Series SM36" of the Interatom Company.

A particularly simple type of matching would be to define the drawn current for a frequent mean radiation intensity. This, however, would have the disadvantage that the possible, higher current, given more intense radiation, could not be exploited and that the voltage would collapse given weaker radiation and charging would no longer be possible.

On the other hand, it can be conceived to continuously check the yield of the solar generator and to match the current to the value of the maximum power resulting from the yield in order to achieve a regulation to maximally-possible power. Such a regulator, however, involves a relatively great expense because of the circuit expense required.

SUMMARY OF THE INVENTION

The object of the present invention, therefore, is to provide a circuit arrangement of the type initially set forth such that, given relatively low expense, the arrangement guarantees operation of the solar generator at an operating point which becomes largely close to the operating point of maximum power in a great operating range.

The above object is achieved, according to the present invention in an arrangement of the type set forth above which is particularly characterized in that the reference voltage generator is formed by a series circuit composed of a first controllable switch which is periodically closed by clock pulses of a clock generator and a short-circuit current precision resistor for the measurement of the short-circuit current of the solar generator, and a sample and hold circuit connected to the short-circuit current precision resistor is connected to the input for the connection of the solar generator. The short-circuit current of the solar generator feeding the load is periodically evaluated in this manner. The short-circuit current of the solar generator is measured with particular precision and with a particularly low power consumption. The circuit arrangement therefore works with particularly good efficiency.

In the case of regulation, the circuit arrangement is advantageously constructed in a manner which is characterized in that a control circuit contains a comparator, the comparator comprising an actual value input in addition to a reference voltage input with the actual value input connected to a natural value generator. In addition, the final control element is controllable such that the test voltage output by the actual value generator at least approximately assumes the value of the reference voltage. Moreover, the central control circuit has its actual value input connected to a load precision resistor for measuring the current drawn from the solar generator, the load precision resistor being arranged in the main circuit and forming the actual value generator. The precision resistor is dimensioned such that the reference voltage and the test voltage coincide with one another when the current drawn from the solar generator has a prescribed ratio to the respective short-circuit current of the solar generator.

According to another feature of the invention, the load is connected to the first controllable switch by way of a switching regulator, the switching regulator contains a storage inductor in a series arm and a second controllable switch and a shunt arm, the second controllable switch being controlled by the control circuit. The load is connected to the second controllable switch via a diode and the storage arrangement comprising a diode and a series arm and a capacitor and a shunt arm is connected between the first controllable switch and the switching regulator. Furthermore, the pulse-to-pause ratio of the pulse sequence controlling the first controllable switch is smaller than 1:10. The pulse-to-pause ratio of the pulse sequence which closes the first controllable switch can, in particular, be 1:1000, so that the effieiency is practically not deteriorated.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
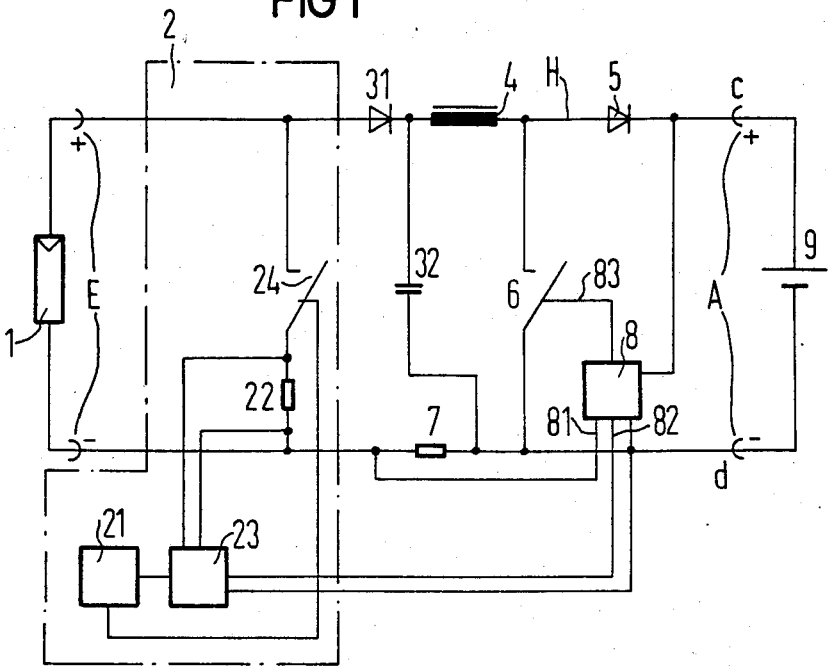
FIG. 1 is a schematic circuit diagram of a circuit arrangement for feeding a battery from a solar generator in which the short-circuit current of the feeding generator is measured and is employed for forming a reference quantity for a current regulation.

Referring to the circuit arrangement illustrated in FIG. 1, a battery 9 is fed from a solar generator 1*a* by way of a control device. The primary circuit H extends from the positive pole of the solar generator 1*a* via a diode 31 poled in the conducting direction, an inductor 4 and a diode 5 poled in the conducting direction, the circuit extending to the positive pole of the battery 9 and from the negative pole of the battery 9 to the negative pole of the solar generator 1*a* via a precision resistor 7.

Connected in parallel with the solar generator 1*a* in a first shunt arm is a series circuit composed of an electronic switch 24 controlled by a clock 21 and a short-circuit current measuring device 2. A sample and hold circuit 23, also controlled by the clock 21, is likewise connected to the short-circuit precision resistor 22. In a modification of this arrangement, the resistor 22 can be arranged in a series arm between the solar generator 1*a* and the first shunt arm instead of being arranged in the first shunt arm. Lower losses occur given an arrangement in the first shunt arm.

A capacitor 32 is connected in a second shunt arm between the junction of the diode 31 and the inductor 34, on the one hand, and the junction of the resistor 7 and the load 9, on the other hand.

An electronic switch 6, controlled by a control circuit 8, is connected in a third shunt arm between the junction of the inductor 4 with the diode 5, on the one hand, and the junction of the load current resistor 7 with the battery 9, on the other hand.

In a manner not shown, but clear to those skilled in the art, the control circuit 8 is supplied with a voltage from the solar generator 1*a*. The negative pole of the battery 9 simultaneously serves as a ground connection or, respectively, a reference potential. The reference value input 82 of the control circuit 8 is connected to the output of the sample and hold circuit 23 of the reference value generator 2*a*. The actual value input 81 of the control circuit 8 is connected to that terminal of the precision resistor 7 which faces away from the battery 9.

The storage inductor 4, the electronic switch 6 and the rectifier 5 represents the power components of a known step-up converter. The switches advantageously composed of a semiconductor component.

The static charge converter charges the battery 9 from the solar generator 1*a*. The regulating device or, respectively, control circuit 8 compares the current of the solar generator measured at the precision resistor 7 to the value of the short-circuit current of the solar generator 1*a* measured at the short-circuit current precision resistor 22 and regulates the current to a prescribed fraction of the respectively-measured value of the short-circuit current. The regulated current occurs from the pulse-to-pause ratio of the pulses which close the second switch. The pulse-to-pause ratio can be carried out by pulse-duration modulation given a fixed sampling frequency or by way of varying the frequency given a fixed pulse duration.

The capacitor 32 serves the purpose of making the required current pulses available to the step-up converter and of also making an adequate input voltage available during the short time intervals in which the short-circuit current is measured. The diode 31 sees to it that the capacitor 32 is not discharged when the electronic switch 24 is closed.

After reaching the maximum charging voltage of the accumulator, the control circuit 8 switches to voltage regulation and prevents a further voltage increase or switches back to the lower value for maintenance charging, as a result whereof the current drawn can drop. The yield of the solar generator is then no longer fully exploited.

The precision resistor 7 measures the DC current output by the solar generator 1*a*. When, in a departure from FIG. 1, the precision resistor is arranged between the capacitor 32 and the switch 6, then a voltage corresponding to the DC current can be acquired by mean value formation or, respectively, by elimination of the AC current component caused by the switch 6.

Figure 2:
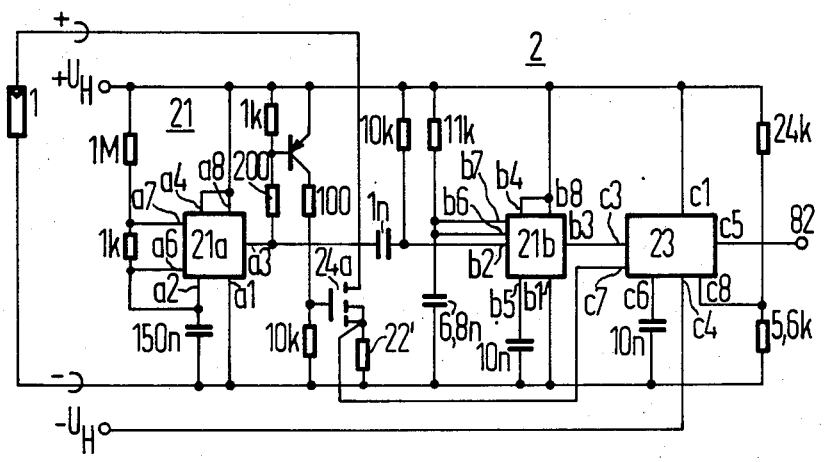
FIG. 2 is a schematic circuit diagram of an apparatus for measuring the short-circuit current of the solar generator for a circuit arrangement of the type set forth in FIG. 1.

Referring to FIG. 2, apparatus is shown for measuring the short-circuit current of the solar generator which comprises a series circuit composed of the source-drain path of a field effect transistor 24*a* and the short-circuit current precision resistor which is parallel to, for example, a 36 volt solar generator 1*a*. The field effect transistor 24*a* forms the electronic switch 24 of the circuit arrangement of FIG. 1 and is periodically closed by clock pulses of the clock 21. The clock 21 is composed of a clock module 21*a* and external connections, as shown.

The field effect transistor 24*a* is driven by the clock 21 by way of an inverter. The clock 21 emits pulses at a spacing of 100 msec., the duration of these pulses respectively amounting to 100 μsec. The pulse-pause ratio of the test pulses with which the short-circuit current of the solar generator 1*a* is measured, therefore, amounts to 1:1000.

The timing module 21*b* derives sampling pulses from the 100 μsec pulses of the clock module 21*a*, the duration of these pulses amounting to only 85–90 μsec., so that the last 10–15% of the pulse width of the test pulse is not evaluated. The sample and hold circuit 23 has its sampling pulse input c3 connected to an output b3 of the timing module 21*b*. Since the sampling pulse always ends before the short-circuit current test pulse, decay events of the test pulse cannot falsify the value to be stored in the sample and hold circuit.

The source electrode of the field effect transistor for connecting to the precision resistor 22 is connected to the test pulse input c7 of the sample and hold circuit 23. The sample and hold circuit 23 emits a reference voltage at its output 82 which is proportional to the short-circuit current of the solar generator 1*a*.

An exemplary embodiment of the apparatus for measuring the short-circuit current of the solar generator proceeds from FIG. 2, together with dimensioning rules.

Serving as a clock module 21*a* is an integrated circuit TCL 555 C. The timing module 21*b* is the integrated circuit TCL 555 C. The field effect transistor 24*a* is a field effect transistor of the type BUZ 27.

The designation of the terminals of the clock module 21*a* and the timing module 21*b* contain the terminal numbers which are standard for the appertaining integrated circuits.

In order to avoid double references, the terminal number of the clock module 21*a* is respectively preceded by an "a" and is respectively preceded by a "b" at the timing module 21*b*.

The positive auxiliary voltage $+U_H$ and the negative auxiliary voltage $-U_H$ amount to, for example, ±12 V. The auxiliary voltages are generated with the assistance of a standard device (not shown). This device can contain an input capacitor which is connected to the solar generator via a decoupling diode. The stabilizing circuit having a transistor in a series arm and a Zener diode as a reference value generator in a shunt arm can be connected to the input capacitor. A constant current diode advantageously is connected in parallel to the base-collector path of the transistor. The voltage stabilized in this manner is advantageously supplied to a converter module which outputs of the positive auxiliary voltage $+U_H$ and the negative auxiliary voltage $-U_H$. An integrated circuit of the type SI 7661 can be employed, for example, as the converter module.

Figure 3:
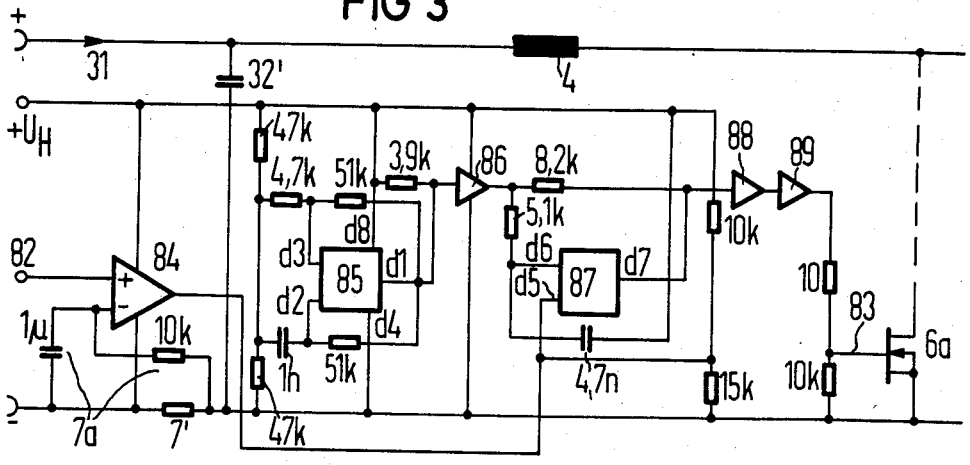
FIG. 3 is a schematic circuit diagram of a control circuit for controlling the electronic switch of a static frequency converter, likewise for a circuit arrangement of the type illustrated in FIG. 1.

FIG. 3 illustrates a control circuit for controlling a field effect transistor 6*a* which forms the switch 6 of the arrangement of FIG. 1.

An operational amplifier 84 has its non-inverting input connected to an output 82 of the sample and hold circuit 23 of FIG. 1 or, respectively, of FIG. 2. The precision resistor 7 is connected at one side to the reference potential of the operational amplifier 84. The other side of the precision resistor 7 is connected by way of the further resistor to the inverting input of the operational amplifier 84. A voltage which is proportional to the momentary value of the current taken from the solar generator is therefore across the precision resistor 7. The residual ripple of the test voltage is reduced with the assistance of an RC element 7*a*. A voltage which is proportional to the repetitive error lies at the output of the operational amplifier 84.

The output of the operational amplifier 84 is fed to a terminal d5 of a pulse-width modulator 87. The pulse-width modulator 87 emits duration-modulated control pulses for controlling the field effect transistor 6*a*, emitting the control pulses at its output d7 dependent on the repetitive error. This is achieved in that the value proportional to the repetitive error which is supplied to the input d5 is compared to a sawtooth voltage supplied to the input d6. The sawtooth voltage is generated with the assistance of an oscillator 85 whose frequency amounts to, for example, 50 kHz.

An inverter 86, which steepens the signal edges of the output pulses of the oscillator 85, is connected between the output of the oscillator 85 and the input d5 of the pulse-width modulator 87. An iterative circuit composed of an inverter 88, likewise serving to steepen pulse edges, and of an inverter 89, serving as a driver, is connected between the output of the pulse-width modulator 87 and the gate electrode of the field effect transistor 6*a*.

A voltage proportional to the repetitive error is acquired in the operational amplifier 84 from the reference voltage fed thereto from the sample and hold circuit 23 and from the actual value measured at the precision resistor 7. The value of the precision resistor amounts to, for example, 8 mohm. The short-circuit current precision resistor 22 has a value of, for example, 6.8 mohm. The ratio of resistance of the resistors 7 and 22 amounts to, in this case, 0.85. This is the given ratio of the current taken from the solar generator to the respectively-measured short-circuit current of the solar generator.

The storage capacitor 32 has a capacitance of, for example, 8000 μF and forms a low-impedance voltage source for the charging regulator connected thereto. The rectifier 31 prevents the storage capacitor 32 from discharging via the short-circuit current precision resistor 22.

An exemplary embodiment of a control circuit with dimensioning particulars is illustrated in FIG. 3. An integrated circuit module LM 393 thereby serves both as the oscillator 85 and the pulse-width modulator 87.

An integrated module of the type 4049B is employed as the inverter 86 and as the driver 89, whereby the driver is formed by four inverters connected in parallel. The designations of the terminals of the oscillator 85 and the pulse-width modulator 87 contain the terminal numbers which are standard for the integrated circuit module LM393. These terminal numbers are respectively preceded by a "d".

Figure 4:
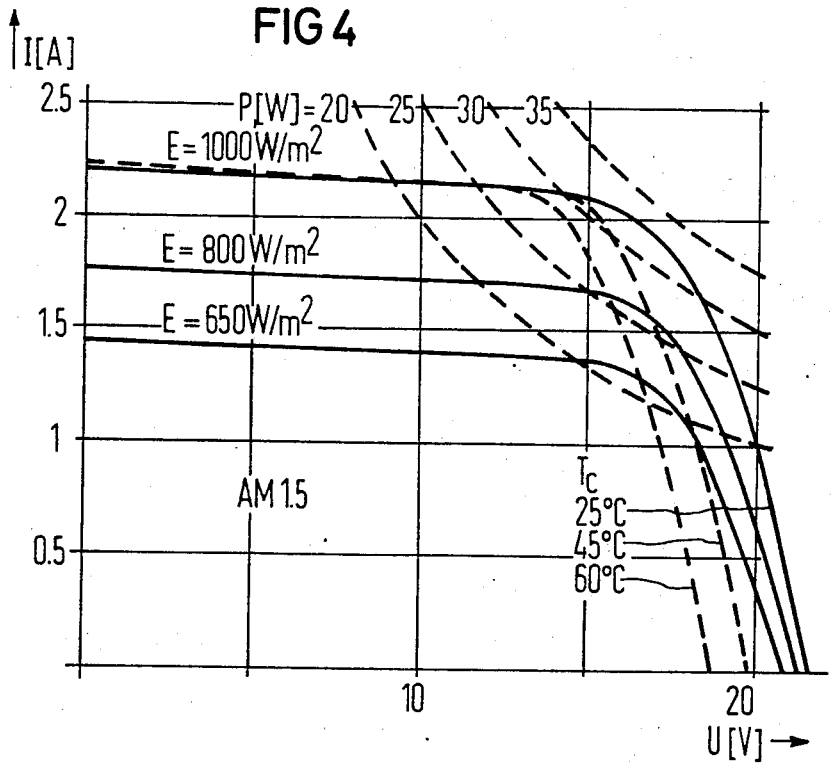
FIG. 4 is a graphic illustration of a typical characteristic field of a solar generator which, in particular, illustrates the temperature dependency of the short-circuit current.

In the characteristic field illustrated in FIG. 4, an operating point should occur at which, dependent on radiation and temperature, an optimally-large product of voltage and current is to be exploited and made useable for battery charging. What is thereby problematical in the matching to the yield of the generator is that the power suppliable to the generator is also dependent on the radiation intensity and on the temperature, in addition to be dependent upon its type and size.

In the circuit arrangement of FIG. 1, an operating point is selected at which the load current has a prescribed ratio to the measured short-circuit current. Prescribed ratio can be identified for the respective solar generator being employed in that, for the relevant characteristics, the current at the operating point of maximum power is respectively divided by the appertaining short-circuit current and a mean value is formed from the quotient thus acquired.

As investigations within the scope of the invention have shown, a fraction on the order of between 80% and 90% allows results to be achieved which depart to a comparatively slight degree from the case of an accurate calculation of the operating point of maximum power.

FIG. 1 illustrates a preferred exemplary embodiment of the invention which contains a step-up converter as a current regulator. The generator voltage is thereby stepped up to the required charging or, respectively, load voltage. In comparison to step-up converters having exclusive regulation of the output voltage, the advantage derives that the regulator does not attempt to take such a high current from the solar generator that the generator voltage collapses.

Instead of the illustrated step-up converter, other known regulation arrangements, particularly blocking converters and forward converters can also be employed in a corresponding manner. These are usually constructed with pulse-width control and comprise a transformer.

In the circuit arrangements illustrated, the current output by the solar generator is regulated, a commercially-available regulator module, constructed as an integrated circuit, can thereby particularly serve as the control circuit 8.

An advantageous modification of the circuit arrangement of FIG. 1 is particularly comprised in that the load current precision resistor 7 is replaced by a short-circuit and the input 81 of the control circuit 8 is eliminated. This simplification of the circuit arrangement is possible when the control circuit 8 is constructed as what is referred to as a forward regulator which forms a prescribed control quantity for the control of the final control element 6 for every measured value of the short-circuit current of the solar generator. The control circuit 8 thereby advantageously contains a comparator which compares a sawtooth voltage to the test voltage proportional to the short-circuit current or to a voltage derived therefrom and, given equality of the voltages, switches the electronic switch 6 off, the switch 6 having been switched on at the beginning of the sawtooth. On the basis of an appropriate design of the sawtooth, a control characteristic can thereby be achieved with which the requirement that the load current of the solar generator should have a prescribed ratio to the short-circuit current of the solar generator can be met with comparatively little expense and with a coincidence which is adequate for practice.

Although we have described our invention by reference to particular embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A circuit arrangement for feeding a load from a solar generator comprising:

an input for connection to the solar generator and an output for connection to the load;

a reference voltage generator including a first switch and a precision resistor connected across said input, and a clock connected to said first switch and operable to generate clock pulses to periodically close said first switch so that reference voltage pulses are produced across said first precision resistor representing the short-circuit current of the solar generator;

a sample and hold circuit connected to said first precision resistor and connected to and operated by said clock for sampling the reference voltage pulses;

a second switch connected across the output of said arrangement;

actual value means connected to said input for measuring the current drawn from the solar generator and producing a representative actual voltage; and a control circuit connected to said second switch to said actual value means and to said sample and hold circuit and operable to open and close said second switch in response to the reference and actual voltages such that the current drawn from the solar generator has a prescribed ratio with respect to the short-circuit current.

2. The circuit arrangement of claim 1, wherein:

said control circuit comprises a comparator including an actual value input connected to said actual value means, a reference value input connected to said sample and hold circuit and an output connected to said second switch and operable to switch said second switch such that the measured actual voltage approximately assumes the value of the reference voltage; and said precision resistor is a first precision resistor and said actual value means comprises a second precision resistor connected in series between said input and said output and dimensioned such that the actual voltage and the reference voltage coincide when the current drawn from the solar generator has the prescribed ratio with respect to the short circuit current.

3. The circuit arrangement of claim 2, and further comprising:

a switching regulator connected between said first switch and said output, said switching regulator comprising a series arm including an inductor and a shunt arm including said second switch;

a first diode connecting said inductor to said output; and a storage circuit comprising a series arm including a second diode connecting said inductor to said input and a shunt arm connected across said first switch with said second diode therebetween.

4. The circuit arrangement of claim 1, wherein: said clock comprises means for producing a pulse-to-pause ratio of less than 1:10 for controlling said first switch.

5. The circuit arrangement of claim 1, wherein: said reference voltage generator comprises a timing module connected to said clock and to said sample and hold circuit and operable such that the voltage appearing across said precision resistor is evaluated only during a portion of the duration of a voltage pulse.

* * * * *